US006795099B2

(12) United States Patent
Koga et al.

(10) Patent No.: US 6,795,099 B2
(45) Date of Patent: Sep. 21, 2004

(54) LASER BEAM WITH CONTROLLABLE LIGHT QUANTITY FEATURE USABLE IN AN IMAGE FORMING APPARATUS

(75) Inventors: Katsuhide Koga, Kashiwa (JP); Fumitaka Sobue, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/360,612

(22) Filed: Feb. 10, 2003

(65) Prior Publication Data

US 2003/0156180 A1 Aug. 21, 2003

(30) Foreign Application Priority Data

Feb. 8, 2002 (JP) ..... 2002-033103
Nov. 26, 2002 (JP) ..... 2002-342719
Dec. 27, 2002 (JP) ..... 2002-380874

(51) Int. Cl.[7] ..... B41J 2/435; G03G 15/04
(52) U.S. Cl. ..... 347/129; 347/133; 347/246
(58) Field of Search ..... 347/129, 131, 347/132, 133, 236, 237, 246; 399/51

(56) References Cited

U.S. PATENT DOCUMENTS 5,491,506 A 2/1996 Yagishita et al. ..... 347/246
6,466,244 B2 * 10/2002 Itoh ..... 347/132

FOREIGN PATENT DOCUMENTS

JP 61-097670 A * 5/1986
JP 62-235973 A * 10/1987
JP 63-180979 A * 7/1988
JP 01-206368 A * 8/1989
JP 5-130332 5/1993
JP 2002-236400 A * 8/2002

* cited by examiner

*Primary Examiner*—Susan Lee
(74) *Attorney, Agent, or Firm*—Fitzpatrick, Cella, Harper & Scinto

(57) ABSTRACT

An image forming apparatus for forming an image by irradiating a charged surface of a photosensitive member with a laser beam depending on a picture signal to form an electrostatic latent image, visualizing the latent image with a recording agent, and transferring the visualized image onto a recording medium; includes a circumferential position detection unit for detecting a circumferential position of the photosensitive member irradiated with the laser beam and an APC circuit for controlling a light quantity of the laser beam so as to provide a target light quantity varying depending on the detected circumferential position.

18 Claims, 11 Drawing Sheets

LASER BEAM WITH CONTROLLABLE LIGHT QUANTITY FEATURE USABLE IN AN IMAGE FORMING APPARATUS

FIELD OF THE INVENTION AND RELATED ART

The present invention relates to a laser control technique for an image forming apparatus such as a laser beam printer (LBP) or a copying apparatus, using electrophotography.

Heretofore, in a laser-driver circuit for an image forming apparatus, a method wherein an output of a laser beam is detected in a photodetection period during one scanning and fed back, and a drive current is maintained for one scanning period.

A laser has such a characteristic that it causes self-heating, thus requiring a larger quantity of electric current or obtaining a predetermined quantity of light with a higher temperature. As a result, the predetermined light quantity cannot be obtained only by supplying a predetermined current at all times, thus resulting in a lowering in image qualities. Accordingly, in order to obviate the lowering in image quality, an APC (auto power control) scheme is employed for each one scanning to control a current quantity so as to provide a certain light emission characteristic for each scanning.

Hereinbelow, a specific control method will be described with reference to FIG. 17.

The image forming apparatus of the aforementioned type, as shown in FIG. 17, employs a laser chip 43 consisting of a laser 43A and a photodiode (PD) sensor 43B, and two current sources comprising a bias current source 41 and a pulse current source 42 are adopted to the laser chip 43, thus improving a light emission characteristic of the laser 43A. Further, in order to stabilize emission of light from the laser 43A, the bias current source 41 is caused to give feedback by using an output signal from the PD sensor 43B to automatically control a bias current quantity.

More specifically, based on a full lighting signal from a sequence controller 47, when a logic element 70 outputs an ON-signal to a switch 49, a sum of electric current supplied from the bias current source 41 and the pulse current source 42 flows through the laser chip 43. An output signal at that time is inputted into a current-voltage converter 44, amplified by an amplifier 45, and inputted into an APC circuit 46. The APC circuit 46 supplies a control signal to the bias current source 41 so that the inputted voltage reaches a target voltage. This circuit scheme is called an APC circuit scheme which is generally used as a circuit scheme for driving a laser at present.

The resultant laser beam controlled to have a predetermined light quantity is used for image formation by turning the switch 49 on and off based on data modulated in a Pixel modulation unit 48 (e.g., Japanese Laid-Open Patent Application No. Hei 05-130332).

However, even if a light quantity of laser beam by using the conventional APC circuit scheme is kept constant, there is still room for improvement depending on qualities of photosensitive members used. This is attributable to a non-uniformity in thickness of a film formed on the surface of the photosensitive member. More specifically, even in the case where the same amount of light quantity of a laser beam is irradiated over the entire surface of the photosensitive member shown in FIG. 16(*a*), a resultant surface potential does not become constant, thus causing a potential irregularity in some cases. For instance, in the case where a surface potential distribution in a main scanning direction results in the one shown in FIG. 16(*b*) or a surface potential distribution in a subscanning direction results in the one shown in FIG. 16(*c*), an unevenness in density occurs in the resultant image, thus being desired to be further improved. However, on the other hand, it is very difficult to provide the photosensitive member surface with a uniform film thickness.

SUMMARY OF THE INVENTION

A first object of the present invention is to provide a laser beam control method for an image forming apparatus and an image forming apparatus, capable of improving image qualities by remedying a potential irregularity at the surface of a photosensitive member in the image forming apparatus.

A second object of the present invention is to provide a laser beam control method for an image forming apparatus and an image forming apparatus, capable of correcting two-dimensionally a potential irregularity with a small amount of memory utilization.

In order to achieve the first object, according to a first aspect of the present invention, there is provided a method of controlling a laser beam for an image forming apparatus of the type wherein an electrostatic latent image is formed by irradiating a charged surface of a photosensitive member with a laser beam depending on a picture signal and is visualized with a recording agent, followed by transfer onto a recording medium to form an image, the method comprising:

a step of controlling predetermined drive currents supplied from a plurality of current sources including a first current source and a second current source so that a drive current supplied from the first current source is controlled to be constant during one scanning and a drive current supplied from the second current source is switched during one scanning at a plurality of points on the surface of the photosensitive member, based on light quantities of a laser beam at the time of supplying predetermined drive currents from the first and second current sources to predetermined areas, respectively, in a scanning direction of the laser beam at the surface of the photosensitive member.

By using the laser beam control method, a drive current supplied from the first scanning direction is made constant during one scanning and a drive current supplied from the second scanning direction is switched from point to point with respect to a plurality of points on the photosensitive member surface, so that a potential irregularity at the surface of the photosensitive member can be improved to realize image formation with improved image qualities.

In order to achieve the first object, according to a second aspect of the present invention, there is provided an image forming apparatus, comprising:

an image forming unit for irradiating a charged surface of a photosensitive member with a laser beam depending on a picture signal to form an electrostatic latent image, visualizing the latent image with a recording agent, and transferring the visualized image onto a recording medium to form an image, a memory for storing a correction value in a main scanning direction of the photosensitive member, a circumferential position detection unit for detecting a circumferential position irradiated with the laser beam at the surface of the photosensitive member, and a control unit for setting a target light quantity depending on the detected circumferential position and controlling a light quantity of the laser beam depending on the correction value stored in the memory and the target light quantity.

By using the image forming apparatus, a light amount of laser beam is controlled based on a correction value in a main scanning direction of the photosensitive member and a target light quantity depending on a circumferential position of the photosensitive member, thus further remedying a potential irregularity at the photosensitive member surface to improve image qualities. Further, it becomes possible to accomplish the first object with a small amount of memory usage since a correction value for one line in the main scanning direction is sufficient to accomplish the first object.

In order to achieve the first object, according to a third aspect of the present invention, there is provided an image forming apparatus, comprising:

an image forming unit for irradiating a charged surface of a photosensitive member with a laser beam depending on a picture signal to form an electrostatic latent image, visualizing the latent image with a recording agent, and transferring the visualized image onto a recording medium to form an image, a detection unit for detecting a position in a main scanning direction and a position in a sub scanning direction, at the surface of the photosensitive member irradiated with the laser beam, a memory for having combinations of the positions in the main and sub scanning directions at the surface of the photosensitive member as addresses and storing data indicating a target light quantity for each address, and a control unit for reading out the target light quantity from the memory depending on a position detected by the detection unit and controlling the laser beam so as to provide the target light quantity.

The image forming apparatus includes a memory having an address comprising a combination of positions in main and sub scanning directions at the photosensitive member surface and storing data indicating target light quantities for each address, whereby image qualities are further improved through remedy for potential irregularity of the photosensitive member.

In order to achieve the second object mentioned above, according to the present invention, there is provided an image forming apparatus, comprising:

an image forming unit for irradiating a charged surface of a photosensitive member with a laser beam depending on a picture signal to form an electrostatic latent image, visualizing the latent image with a recording agent, and transferring the visualized image onto a recording medium to form an image, a first memory for memorizing a correction value in a main scanning direction of the photosensitive member, a second memory for memorizing a correction value in a sub scanning direction of the photosensitive member, an arithmetic unit for providing a correction value at a corresponding surface position of the photosensitive member by performing an arithmetic operation of the correction values in the main and sub scanning directions, a circumferential position detection unit for detecting a circumferential position of the photosensitive member irradiated with the laser beam, and a control unit for controlling the laser beam depending on the correction value provided by the arithmetical unit and the circumferential position detected by the circumferential position detection unit.

The image forming apparatus can control a laser light quantity so that a potential irregularity is two-dimensionally corrected based on a tendency of potential irregularity in the main and sub scanning directions at the surface of the photosensitive member, thus improving qualities of image. Further, an amount of memory for one line is only required in each of the main and sub scanning directions, so that an amount of memory utilization can be reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
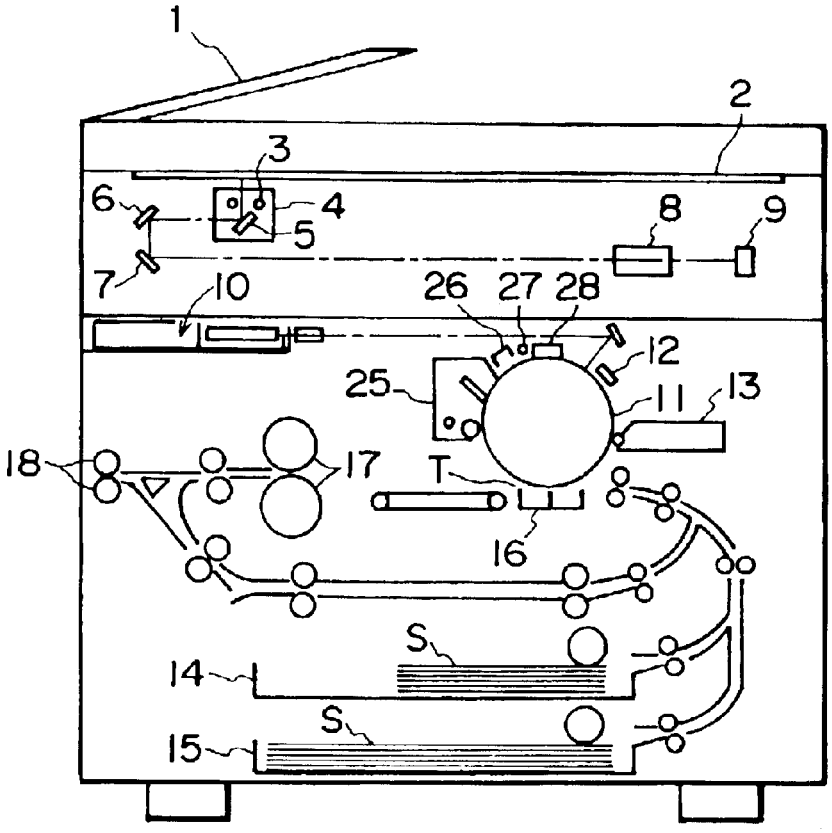
FIG. 1 is a schematic sectional view of a printer as an embodiment of the present invention.

Hereinbelow, preferred embodiments of the image forming apparatus and the laser beam control method therefor according to the present invention will be described in detail with reference to the accompanying drawings. In respective figures, members indicated by identical reference numerals designate identical members and repetitive descriptions of these members are omitted. It should be noted, however, that constructive members shown in the following embodiments were merely illustrative and the present invention is not limited thereto.

Embodiment 1

In this embodiment, a potential irregularity caused by nonuniformity in thickness of a thin film of a photosensitive drum as a photosensitive member is compensated by controlling a light quantity of a laser beam emitted to the photosensitive drum.

Figure 18:
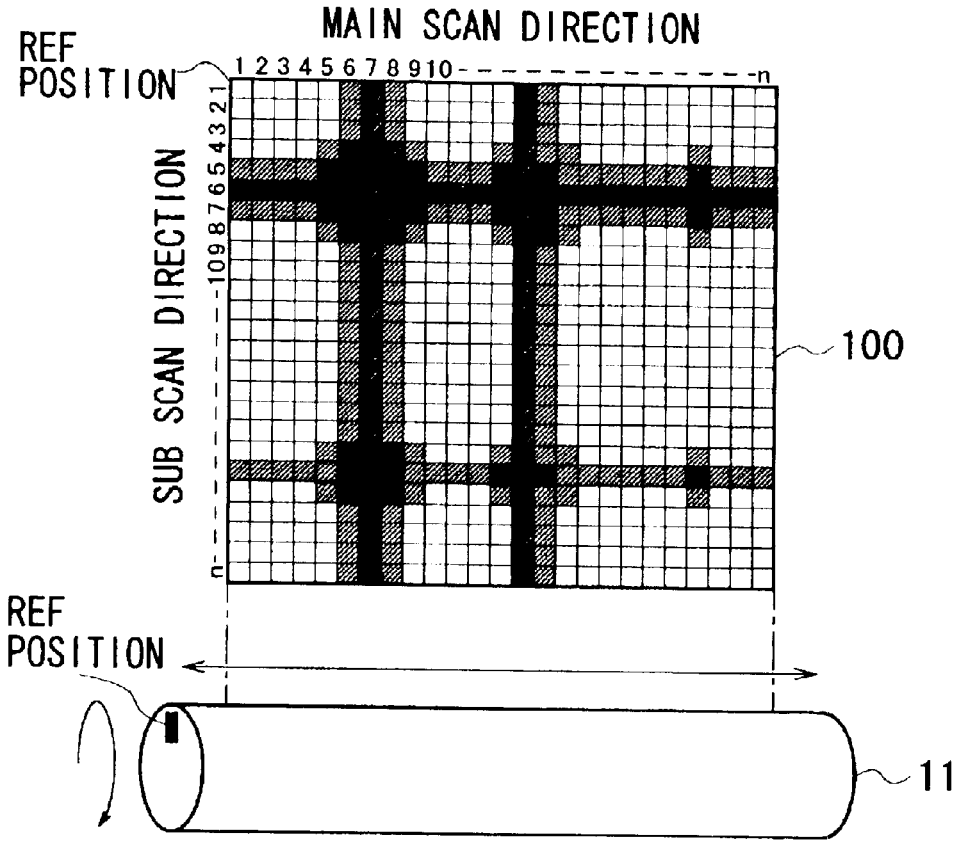
FIG. 18 is a schematic view for illustrating correction of a laser light quantity to be controlled.

FIG. 18 is a schematic view for explaining correction of the laser light quantity. A photosensitive member 11 designates a photosensitive drum (photosensitive member) and a reference numeral 100 designates a distribution of correction values over regions corresponding to the entire surface of the photosensitive drum 11. Referring to FIG. 18, a magnitude of each correction value is indicated by color strength in each square dot. Each square dot corresponds to one or plural pixels.

Figure 19:
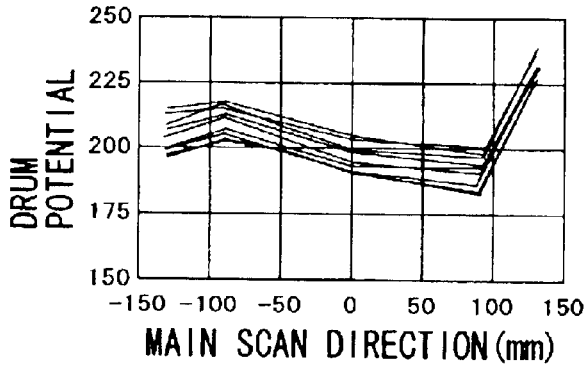
FIG. 19 is a graph showing a potential irregularity in a main scanning direction.

FIG. 19 is a graph showing a potential irregularity in a main scanning direction when the photosensitive drum is irradiated with a laser beam so as to provide a light quantity for forming a halftone. Referring to FIG. 19, absolute potential values vary depending on positions in a sub scanning direction but a tendency of potential irregularity distribution in the main sub direction for respective potential curves is similar to each other.

Figure 20:
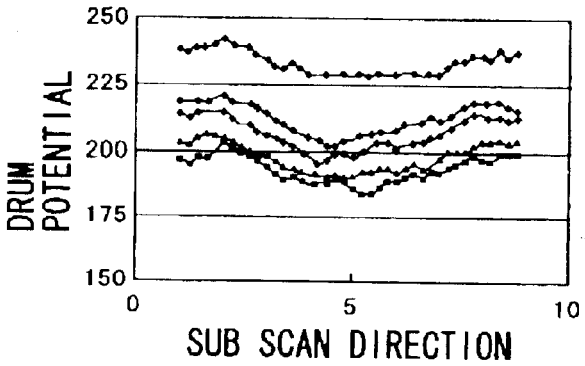
FIG. 20 is a graph showing a potential irregularity in a sub scan direction.

FIG. 20 is a graph showing a potential irregularity in a sub scanning direction when the photosensitive drum is irradiated with a laser beam having a halftone-forming light quantity. Referring to FIG. 20, although absolute potential values vary depending on positions in the main scanning direction, a tendency of potential irregularity distribution for respective potential curves is similar to each other.

In other words, it is found that a nonuniformity in potential level in the main scanning direction shows a similar tendency over the positions in the sub scanning direction and on the other hand, that in the sub scanning direction shows a similar tendency over the positions in the main scanning direction.

In this embodiment, based on such a characteristics of potential irregularity in the main and sub scanning directions, correction is given.

FIG. 1 is a schematic sectional view of a laser beam printer as an image forming apparatus according to this embodiment.

A principal operation of the printer will be described with reference to FIG. 1.

An original placed on a document feeder 1 is carried successively onto an original glass plate sheet by sheet, and a lamp 3 of a scanner unit is turned on while a scanner unit 4 is moved to irradiate the original. A reflected light from the original passes through a lens 8 via mirrors 5, 6 and 7 to be inputted into an image sensor unit 9. An image signal inputted into the image sensor unit 9 is read out directly or after once stored in an unshown image memory, and then is inputted into an exposure control unit 10. A latent image formed on a photosensitive member 11 by an irradiating light generated by the exposure control unit 10 is monitored by a potential sensor 100 whether a potential level at the surface of the photosensitive member 11 reaches a predetermined level, and then is developed by a developing device 13. A transfer medium is conveyed from a first transfer medium loading unit 14 or a second transfer medium loading unit 15 in exact timing with the development of the latent image, and at a transfer position, a toner image developed on the photosensitive member 11 is transferred onto the transfer medium.

The transferred toner image is fixed onto the transfer medium by a fixing unit 17 and then is discharged from a discharge unit 18 to the outside the apparatus. The surface of the photosensitive member 11 after transfer is cleaned by a cleaner 25 and charge-removed by an auxiliary charger 26 for providing a primary charger 28 with a good charging performance. The residual charge potential is removed on the photosensitive member 11 by a pre-exposure lamp 27 and the surface of the photosensitive member 11 is charged by the primary charger 28. This process is repeated to effect image formation on plural sheets of the transfer medium.

Figure 2:
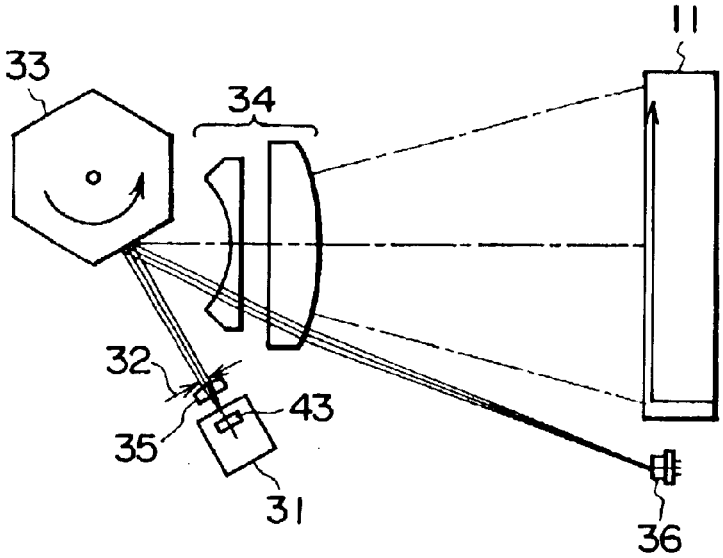
FIG. 2 is a view showing an exposure control unit of a printer according to a first embodiment of the present invention.

FIG. 2 shows a principal construction of the exposure control unit 10. Referring to FIG. 2, the exposure control unit 10 includes a laser drive apparatus 31 and a semiconductor laser 43 in which a PD sensor for detecting a part of laser beam. APC control of the laser diode is performed by using a detection signal detected by the PD sensor. More specifically, a laser beam emitted from the laser 43 is changed into substantially parallel light fluxes by a collimating lens 35 and an aperture diaphragm 32 and is incident on a rotating polygon mirror 33 at a predetermined beam diameter. The polygon mirror 33 is rotated in a counterclockwise direction of an arrow in the figure at an identical angular speed. In correspondence with the rotation of the polygon mirror 33, the incident laser beam is modulated into a deflection beam continuously changing its angle. The deflection beam is focused by an f-θ lens 34. On the other hand, the f-θ lens 34 also correct a distortive aberration at the same time so as to ensure timewise linearity of scanning, so that the surface of the photosensitive member 11 as an image bearing member is scanned with the focused light beam in the direction of an arrow indicated in the photosensitive member 11 at the same speed. Incidentally, a reference numeral 36 designates a beam detection (BD) sensor for detecting the reflection beam from the rotating polygon mirror 33. The detection signal by the BD sensor is used as a synchronizing signal for synchronizing rotation of the polygon mirror 33 with data writing.

Next, a construction and operation of a laser control unit used in this embodiment will be described in detail with reference to FIGS. 3–6.

Figure 3:
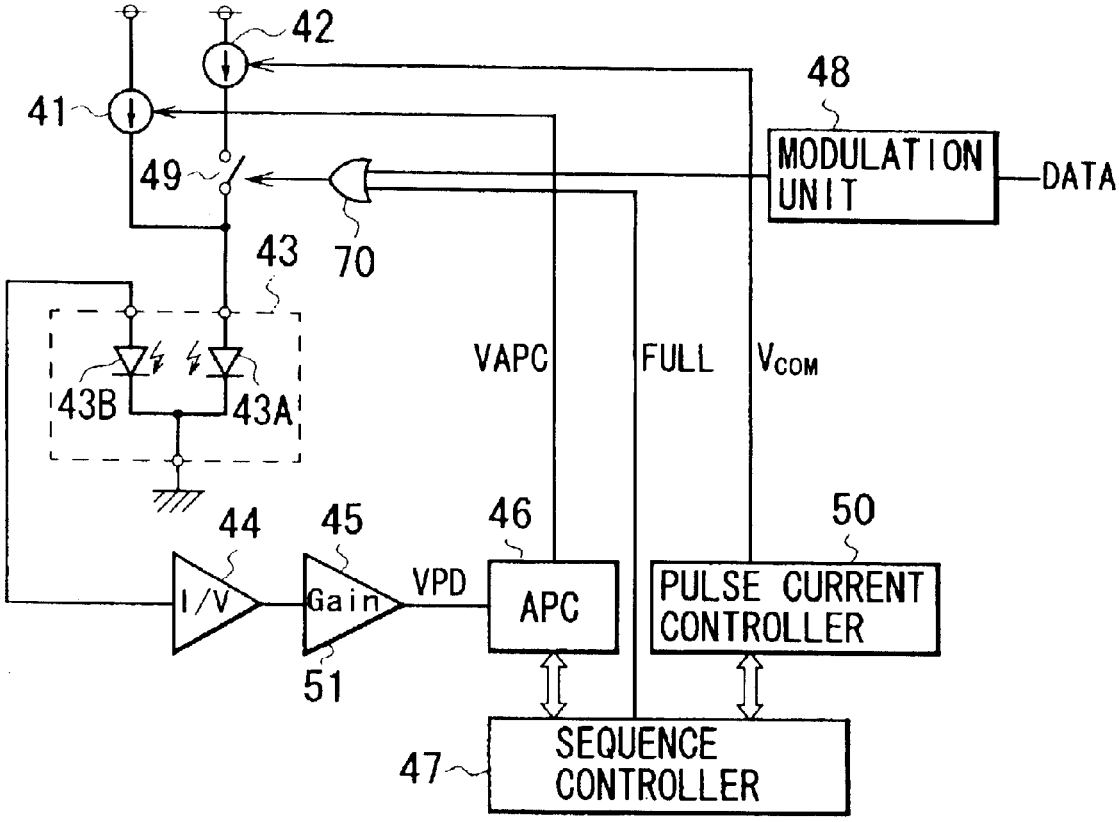
FIG. 3 is a block diagram showing a laser driven circuit according to the first embodiment of the present invention.

Referring to FIG. 3 a laser chip 43 is a semiconductor laser comprising a laser diode 43A and a PD sensor 43B. A reference numeral designates a bias current source of the laser 43A and a reference numeral designates a pulse current source of the laser 43A. An image signal DATA is pixel-modulated in a modulation unit 48. The pixel-modulated signal in the modulation unit 48 and a full lighting signal FULL for detecting BD signal from a sequence controller 47 are subjected to the logical OR operation by a logical element 70. An output signal from the logical element 70 turns a switch 49 on and off.

When the switch 49 is turned on, the laser 43A is controlled to emit light based on the sum of a current amount by the bias current source 41 controlled for each one scanning and a current amount by the pulse current source which is variably controlled plural times during one scanning. When the switch 49 is turned off, the laser 43A emits a laser beam only by a current rom the bias current source 41.

An output signal from the PD sensor 43B when the light quantity of the time of full lighting (light emission) for detecting PD signal is monitored is converted into a voltage signal by a current/voltage (I/V) converter 44, amplified by an amplifier 45, and then is inputted into an APC circuit 46.

Further, the pulse current source 42 is controlled by a signal VCOM outputted from a pulse current control unit 50.

Figure 4:
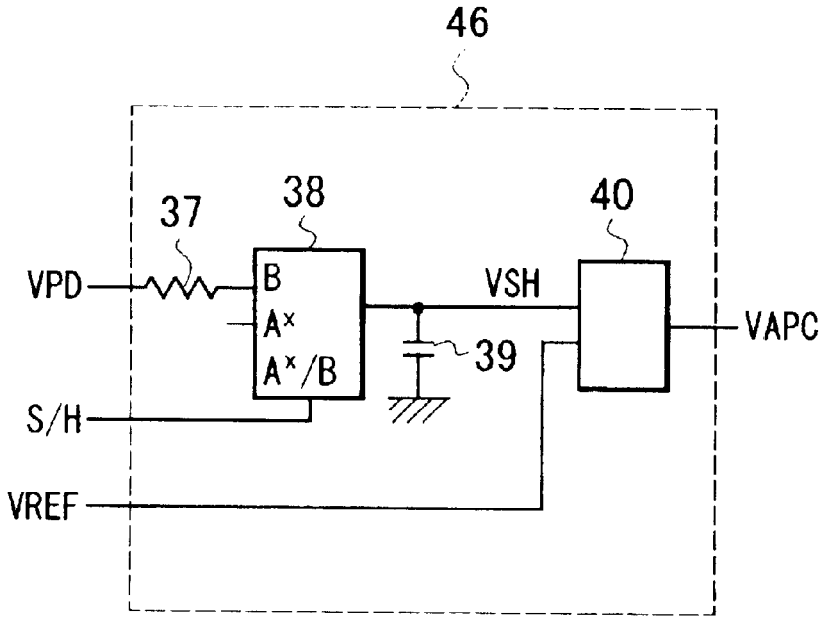
FIG. 4 is a block diagram showing an internal constitution of an APC circuit according to the first embodiment of the present invention.

FIG. 4 shows a circuit diagram showing an internal construction of the APC circuit in detail.

Referring to FIG. 4, a PD sensor output signal VPD amplified by the amplifier 45 is inputted into an analog switch 38 via a resistor 37. The analog switch 38 samples the VPD signal by a sample-and-hold signal S/H from the sequence controller 47 and outputs the VPD signals as a voltage value VSH. The voltage value VSH is a time constant determined by the resistor 37 and a capacitor 39 and is held during one scanning period, followed by input into a comparator 40. In the comparator 40, the voltage value VSH and a preliminarily set voltage value VREF as a target voltage value are compared. The comparator 40 outputs a differential signal VAPC determined by subtracting the voltage value VREF from the voltage value VSH.

Then, a construction and operation of the pulse current control unit 50 variably controlling an amount of pulse current plural times in one scanning period so as to correct a potential irregularity will be described with reference to FIGS. 5 and 6.

Figure 5:
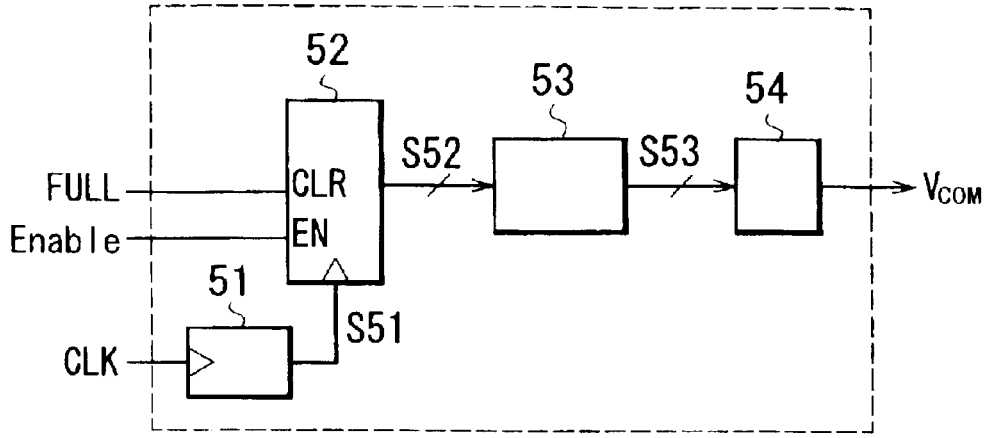
FIG. 5 is a block diagram showing an internal construction of a pulse current control unit according to the first embodiment of the present invention.
Figure 6:
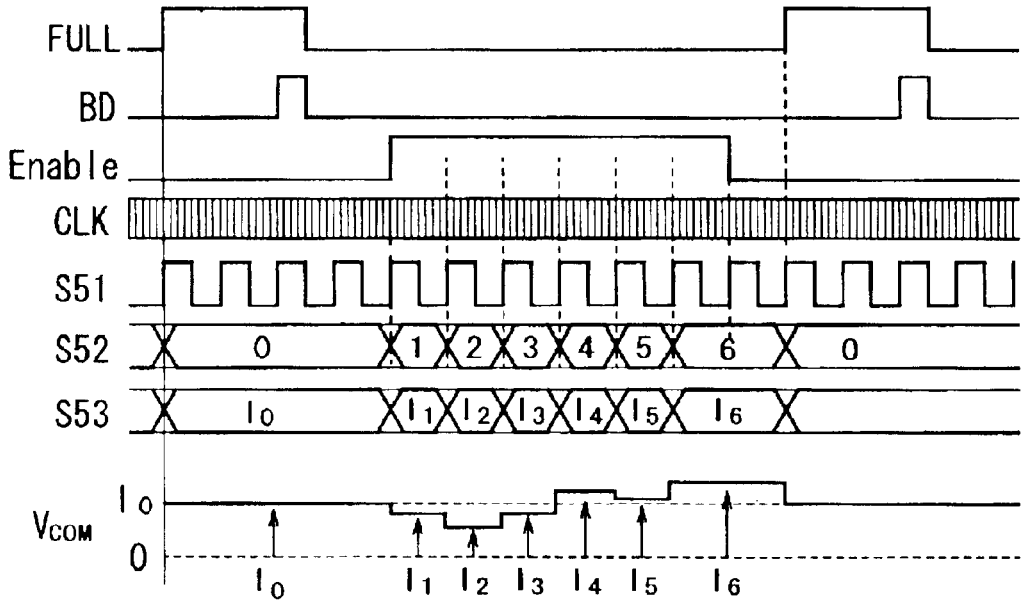
FIG. 6 is a time chart showing a control timing for the pulse current control unit in the first embodiment of the present invention.

Referring to FIG. 5, a clock signal S51 obtained by dividing a pixel clock signal CLK by a divider 51 is inputted into an up-counter 52 for asynchronous clearing with enable signal. The counter 52 outputs "0 (zero)" during a period of inputting the full lighting signal FULL for detecting BD signal, and after the signal FULL is removed, outputs a counted value, obtained by counting the divided clock S51 during which a drum area signal Enable is inputted from the scanning direction 47, as an address to a memory 53 such as RAM (random access memory). In the memory 53, current correction values for main scanning positions on the drum are stored in advance, these values are read out depending on scanning positions, respectively.

A digital output value read out from the memory 53 is inputted into a D/A (digital/analog) converter to convert it into an analog value VCOM; and is outputted to the pulse current source 42. The pulse current source 42 drives the laser 43A by the current value depending on the analog value VCOM. At that time, a value obtained by D/A converting a data $I_0$ at an address 0 in the memory in taken as a default current value as a reference value. In a full lighting period for APC control, full lighting is performed by the sum of the default current value and the aforementioned bias current value to set a target current value for one scanning by the APC circuit. Thereafter, when the scanning position comes to the drum area, the drum is irradiated with the laser beam by driving the laser with the sum of the corrected pulse current value and the bias current value depending on the pixel modulation signal.

As described above, the nonuniformity in potential irregularity in the main scanning direction has a similar tendency over the positions in the sub scanning direction, so that the above-mentioned control is repetitively performed for each scanning operation to allow a simple correction over the entire peripheral surface of the photosensitive drum (member).

Figure 15:
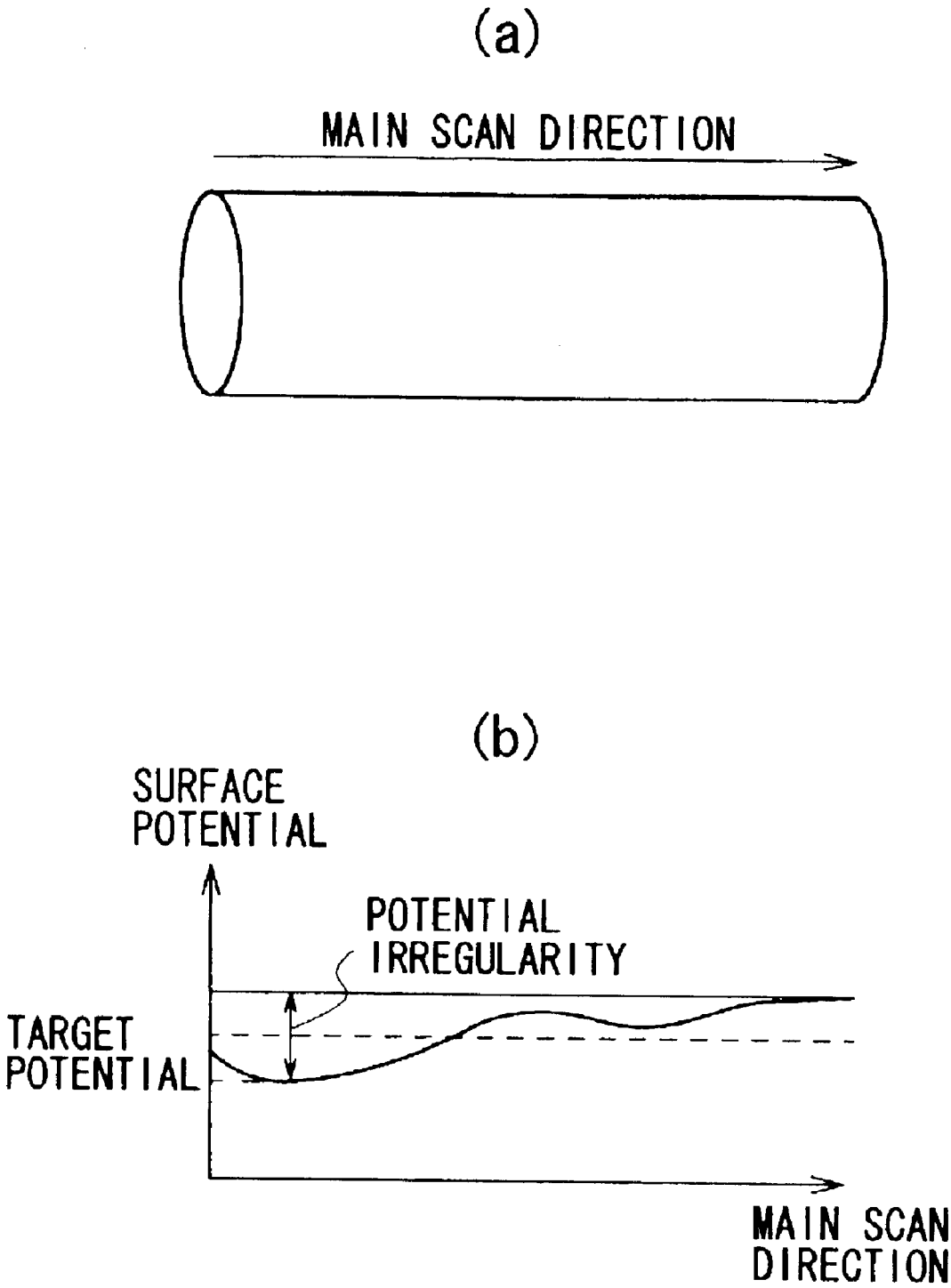
FIG. 15(*a*) is a schematic view of a photosensitive drum having a potential irregularity characteristic as shown in FIG. 15(*b*).

More specifically, even if the photosensitive drum shown in FIG. 15(*a*) exhibits the potential irregularity characteristic as shown in FIG. 15(*b*), at a drum position on the scanning start side, a quantity of the laser drive current is decreased to lower the laser light quantity. As a result, the surface potential comes close to the target potential level. Similarly, the quantity of the laser drive current at respective points in the main scanning direction is controlled to allow an active control of the laser light quantity, whereby the drum surface potential comes close to the target potential level.

Incidentally, a larger number of data stored in the memory 53 lead to a higher resolution, so that more precise current control can be effected. As a result, the drum surface potential is caused to come close to the uniform target potential but in consideration of a sensitivity on the drum, it is not necessary to effect the current value correction for each pixel. The correction is sufficient to effect for several to several hundred pixel unit, thus only requiring a memory corresponding to several to several hundredth part of the pixel number for one scanning.

In this embodiment, the current control is performed only in the main scanning direction, but as described above, the nonuniformity in the main scanning direction has a similar tendency of potential irregularity over positions in the sub scanning direction and on the other hand, that in the sub scanning direction also has a similar tendency with respect to the main scanning direction. Accordingly, it becomes possible to effect a better correction operation by also performing current correction through detection of positions in the sub scanning direction. Such a control method will be specifically described hereinbelow.

Embodiment 2

Figure 7:
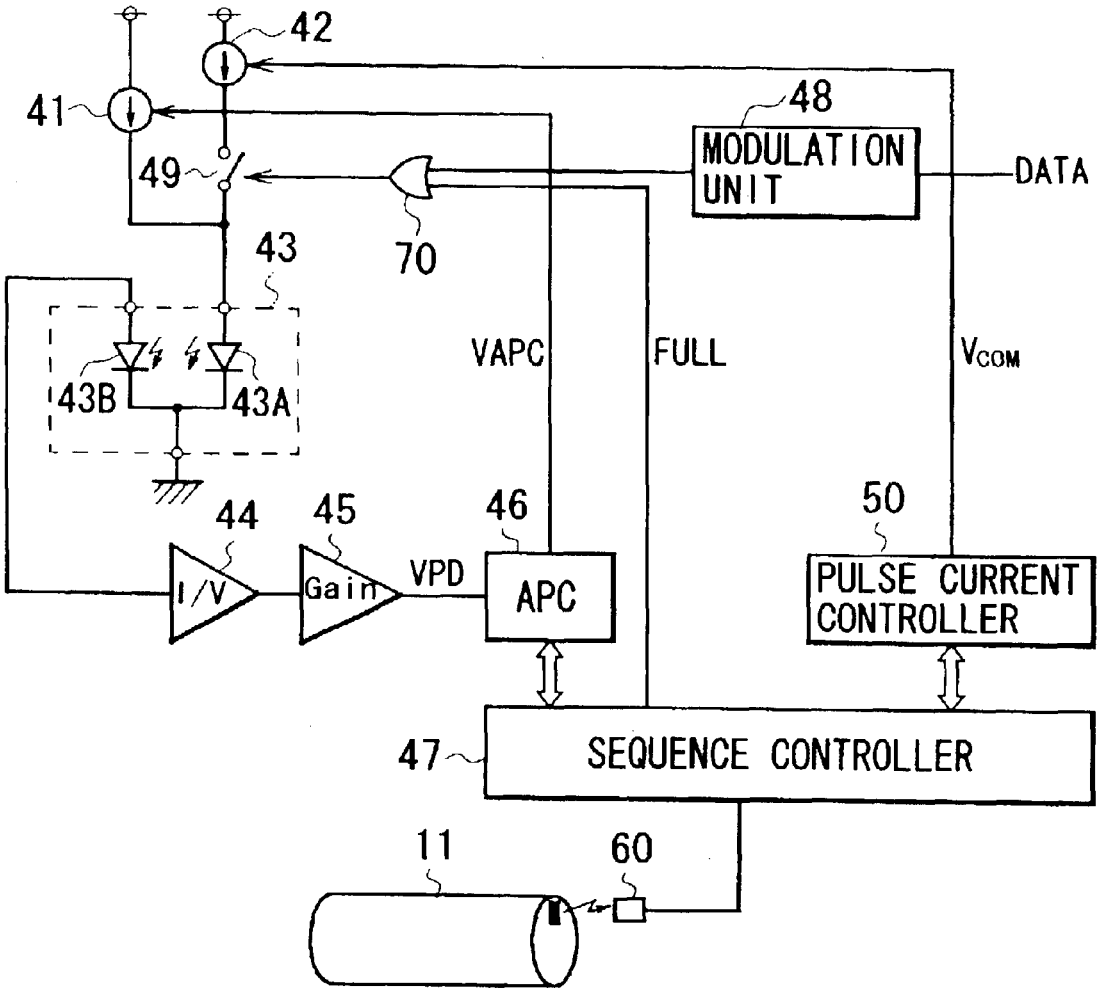
FIG. 7 is a block diagram showing a laser-driven circuit according to a second embodiment of the present invention.

In this embodiment, as shown in FIG. 7, a reference position in a circumferential direction of the photosensitive member 11 provided to the circular side surface (indicated as a black rectangular portion in the photosensitive member 11) is detected by a position detection sensor 60 such as a reflection-type sensor. As reference position detection signal HP detected by the position detection sensor 60 is outputted to the sequence controller 47. The detection signal HP is then inputted from the current source 47 into the APC circuit 46. Other members are similar to those shown in Embodiment 1 described above, and descriptions thereof are omitted.

Figure 8:
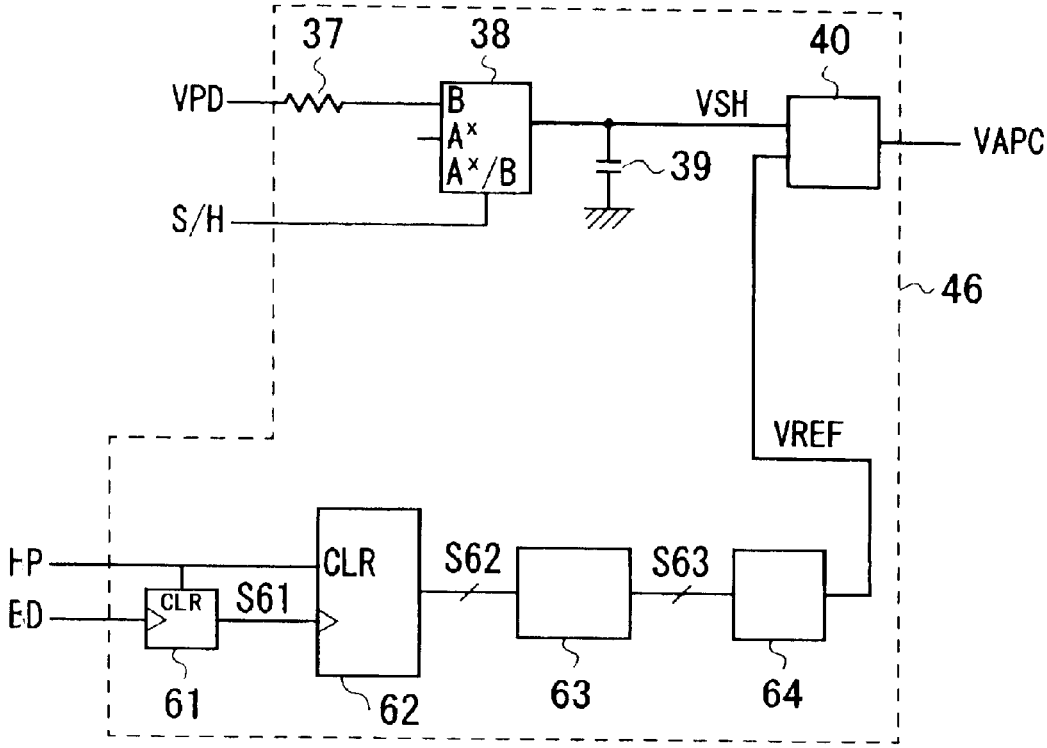
FIG. 8 is a block diagram showing an internal construction of an APC circuit according to the second embodiment of the present invention.

FIG. 8 is a circuit diagram specifically showing an internal construction of the APC circuit.

A PD sensor output signal VPD amplified by an amplifier 45 is inputted an analog switch 38 via a resistor 37. The analog switch 38 samples the VPD signal by a sample-and-hold signal S/H from the scanning direction 47 and outputs the VPD signal as a voltage value VSH. The voltage value VSH is a time constant determined by the resistor 37 and a capacitor 39 and is held during one scanning period, followed by input into VAPC output unit 40.

Further, a divider 61 is cleared by inputting thereinto the reference position detection signal HP and outputs a signal S61, obtained by dividing a BD signal, to a counter 62. In this embodiment, the frequency divider ratio of the BD signal is set to 4.

The counter 62 is cleared by inputting the reference position detection signal HP and counts up the BD divider signal S61 from the divider 61, and then outputs the signal S61 as an address data S62 to a memory 63 such as RAM. The memory 63 stores the address data S62 and potential correction data S63 correlated with each other. The address data S62 is data showing a circumferential position from the reference position of the photosensitive member, so that a potential correction data S63 depending on a position in the sub scanning direction of the photosensitive member is read out from the memory 63 and outputted to a D/A converter 64. The D/A converter 63 converts the potential correction data S63 into analog data VREF as a target voltage value.

Figure 9:
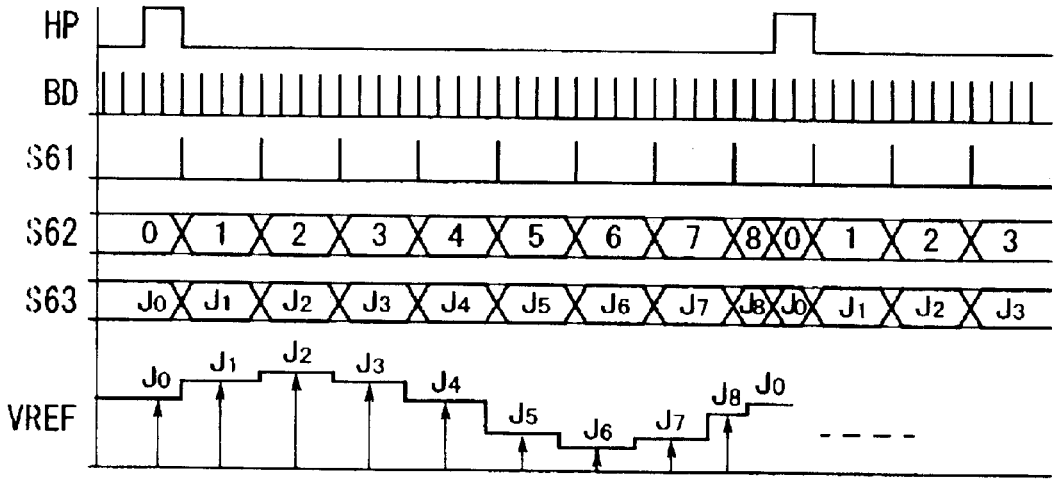
FIG. 9 is a time chart showing a control timing for the APC circuit according to the second embodiment of the present invention.

FIG. 9 is a timing chart for showing a timing of outputting VREF signal against the input of HP and BD signals.

The analog data VREF is compared with the voltage value VSH in the comparator 40. The comparator 40 outputs a differential signal VAPC determined by subtracting the voltage value VREF from the voltage value VSH. The bias current source 41 controls a current value depending on the differential signal VAPC. More specifically, in order that the bias light emission value reaches the target voltage value VREF, if the differential signal VAPC has a positive value and a larger absolute value, the current value is decreased, and on the other hand, if it has a negative value and a larger absolute value, the current value is increased.

As described above, the current value of the bias current source 41 is controlled for each unit scanning of the semiconductor laser 43A in the main scanning direction, whereby it is possible to control a bias light quantity of the semiconductor laser 43A in accordance with a thickness distribution of the thin surface layer of the photosensitive drum.

Incidentally, in this embodiment, the address data S62 inputted into the memory 63 are counted up for every 4 BD signals. As a result, the target voltage is changed for every 4 scanning from the reference position of the photosensitive member, thus correcting the potential irregularity in the circumferential direction of the photosensitive member.

The target voltage VREF stored in the memory 63 can be obtained from a surface potential in the case where an identical light quantity of laser beam is emitted over the entire peripheral surface of the photosensitive drum 11.

Figure 16:
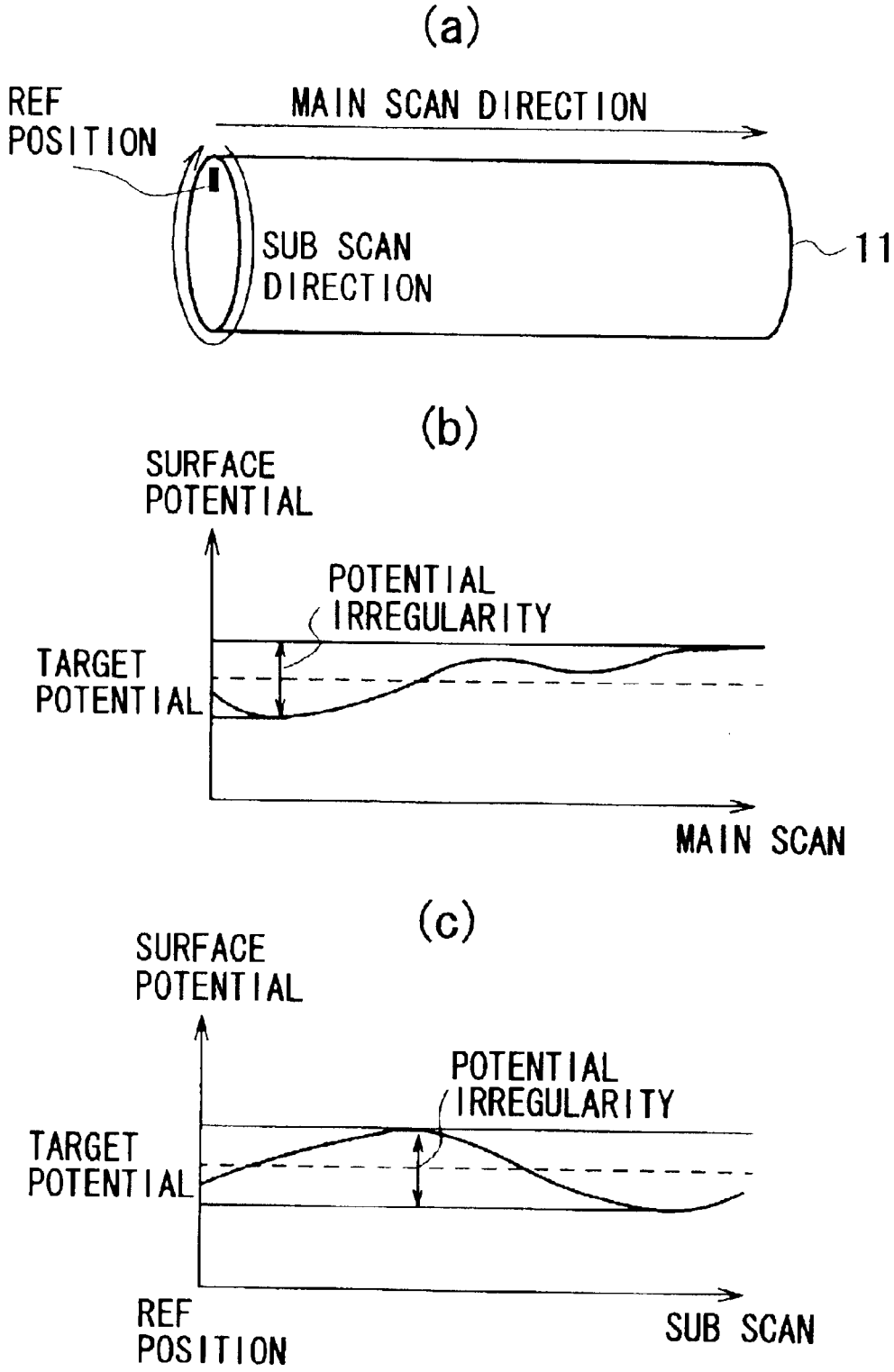
FIG. 16(*a*) is a schematic view of a photosensitive drum having potential 26 irregularity characteristics as shown in FIGS. 16(*b*) and 16(*c*).
Figure 17:
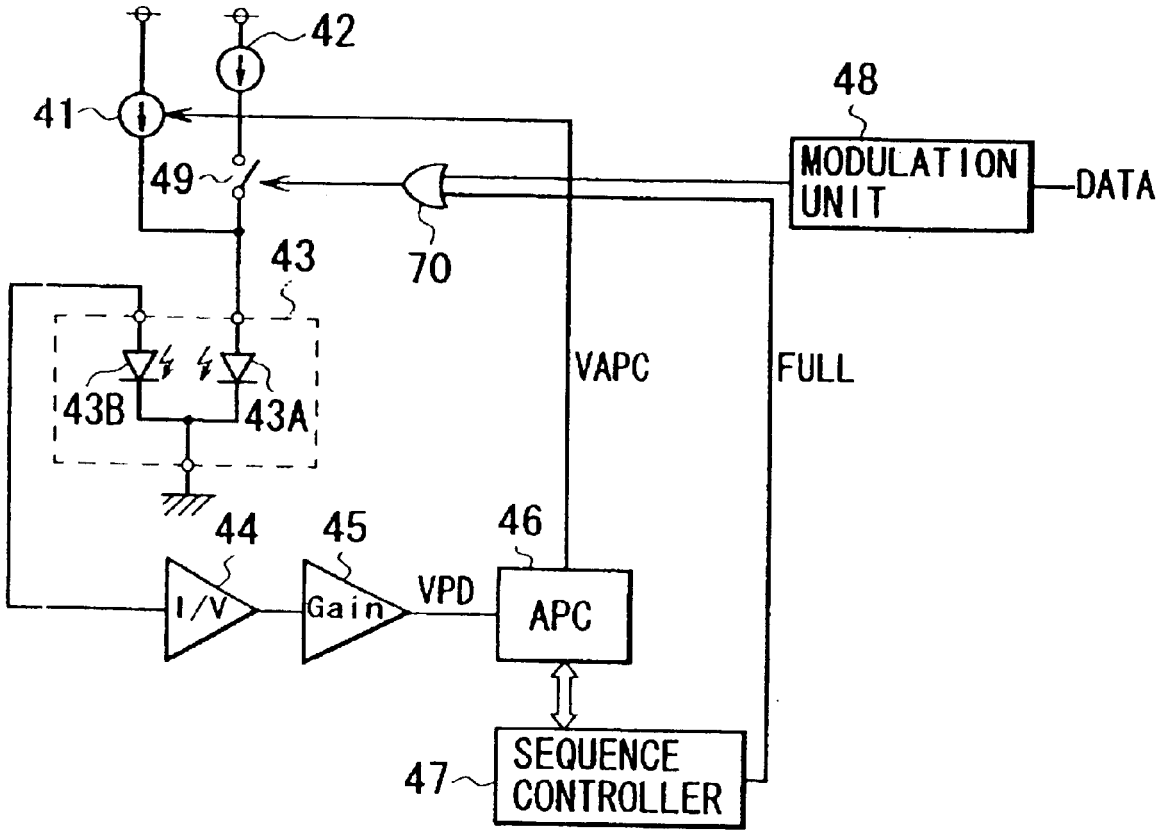
FIG. 17 PRIOR ART
FIG. 17 is a block diagram showing an embodiment of a laser-driven circuit of a conventional printer.

For example, in the case of the photosensitive drum shown in FIG. 16(*a*), when a certain amount of laser beam is emitted, the surface potential is such that it has a distribution as shown in FIG. 16(*c*). In this case, however, the surface potential at the reference position is higher than the target potential. Accordingly, in this embodiment, a light quantity is increased at the reference position by increasing the laser drive current quantity, so that the surface potential can be controlled to be lowered after the laser beam irradiation. Further, at a plurality of points in the subscanning direction, a target light quantity for accomplishing the target potential is determined in advance, and the resultant target light quantity is stored in the memory as the target voltage VREF.

With respect to the correction of potential irregularity in the main scanning direction in this embodiment, the construction and operation of the pulse current control unit 50 which variably controls the pulse current quantity plural times in one scanning are similar to those in Embodiment 1 described above.

According to this embodiment, the liquid light quantity can be controlled to correct the potential irregularity depending-on two-dimensional position at the photosensitive member surface. As a result, it is possible to improve picture (image) qualities, irrespective of the photosensitive member used.

Embodiment 3

Figure 10:
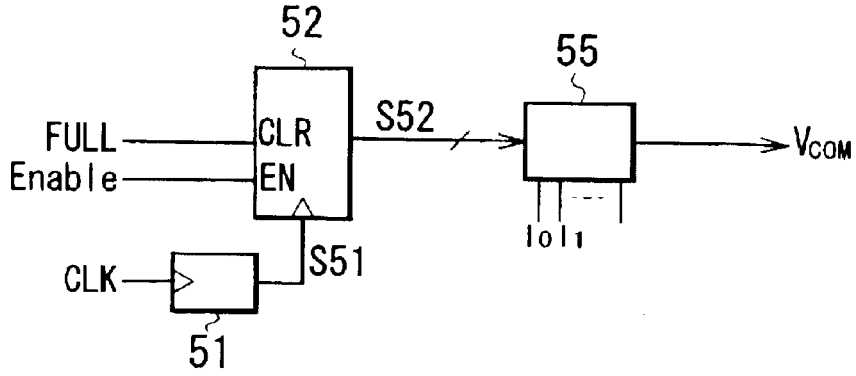
FIG. 10 is a block diagram showing an internal construction of a pulse current control unit according to a third embodiment of the present invention.

This embodiment is shown in FIG. 10.

In this embodiment, as shown in FIG. 10, a correction operation in the main scanning direction is performed without using the memory and the D/A converter. In this embodiment, an analog switch 55 is provided with a plurality of current values in advance by using a variable resistor etc., and the current value for the signal VCOM is switched based on the output signal from the counter 52. Other constructions are similar to those in Embodiment 1.

According to this embodiment, it is possible to attain similar effects as in Embodiment 2 described above.

Embodiment 4

Figure 11:
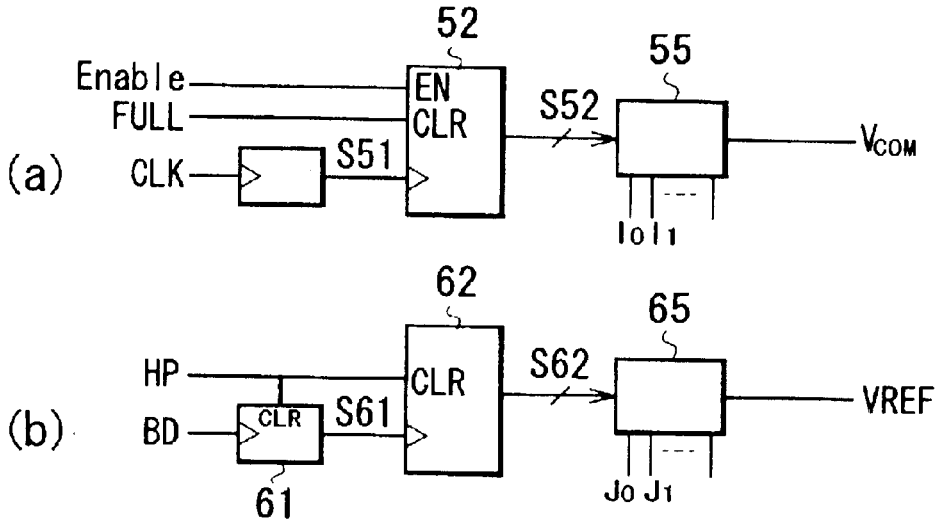
FIGS. 11(*a*) and 11(*b*) respectively, are block diagrams showing an internal c:onstruction of a pulse current control unit and an APC circuit, according to a fourth embodiment of the present invention.

This embodiment is shown in FIG. 11.

In this embodiment, as shown in FIGS. 11(*a*) and 11(*b*), correction operations in both the main and the subscanning directions are performed without using the memory and the D/A converter. Current values or the signals VREF and VCOM are switched based on the outputs from counters 52 and 62 after a plurality of current values are provided to analog switches 55 and 65 in advance by using variable resistors etc. Other constructions are similar to those in Embodiment 2.

According to this embodiment, it is possible to attain effects similarly as in Embodiment 2 described above.

Embodiment 5

Figure 12:
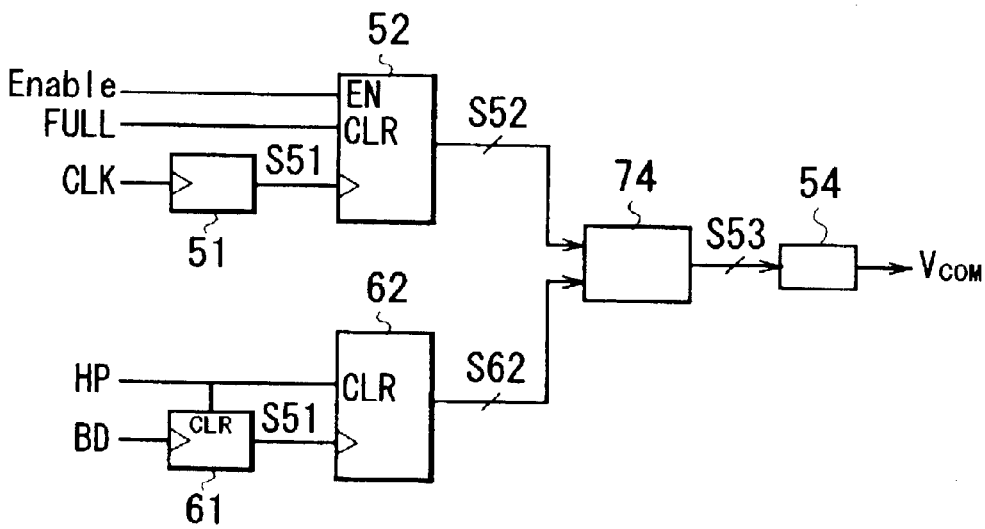
FIG. 12 is a block diagram showing an internal construction of a pulse current control unit according to a fifth embodiment of the present invention.

This embodiment is shown in FIG. 12.

In this embodiment, as an internal construction for the pulse current control unit 50 shown in FIG. 3, a circuit shown in FIG. 12 is employed in place of the circuit shown in FIG. 5.

In this construction, a count value S52 indicating a position of the photosensitive drum in the main scanning direction and a count value S62 indicating a position in the sub scanning direction are inputted into a memory 74 in which a current correction value has been stored in advance by using a combination of these count values S52 and S62 as an address (e.g., as shown in FIG. 18). More specifically the current correction value is readout from the memory depending on a two-dimensional position at the photosensitive member surface and converted into an analog values VCOM by a D/A converter 54, and then is outputted to a pulse current source 42.

As described above, depending on the two-dimensional position at the photosensitive member surface, the laser light quantity is controlled so as to correct the potential irregularity, thus remarkably improving picture qualities, irrespective of the photosensitive member employed.

Embodiment 6

Figure 13:
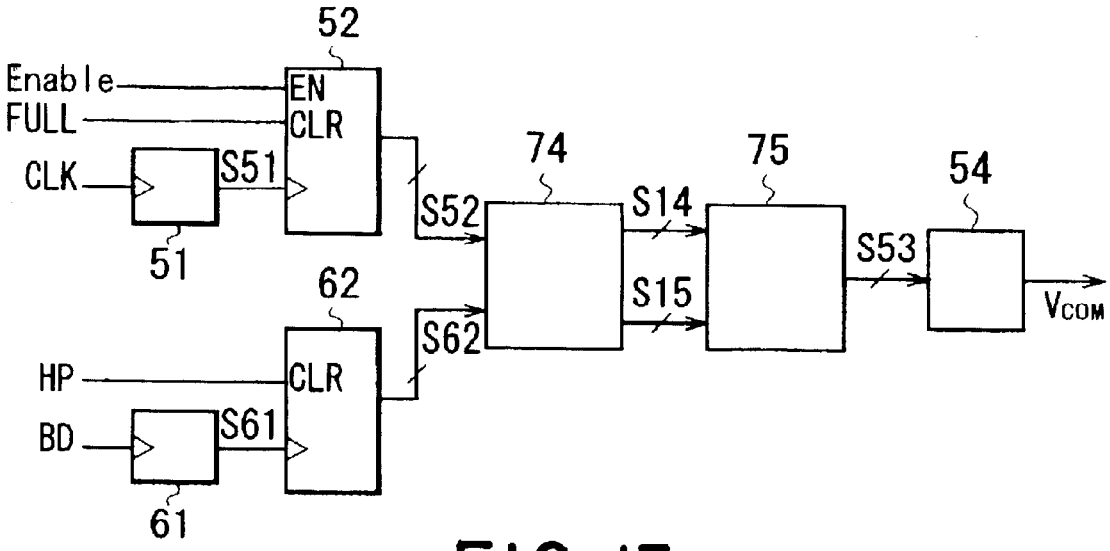
FIG. 13 is a block diagram showing an internal construction of a pulse current control unit according to a sixth embodiment of the present invention.
Figure 14:
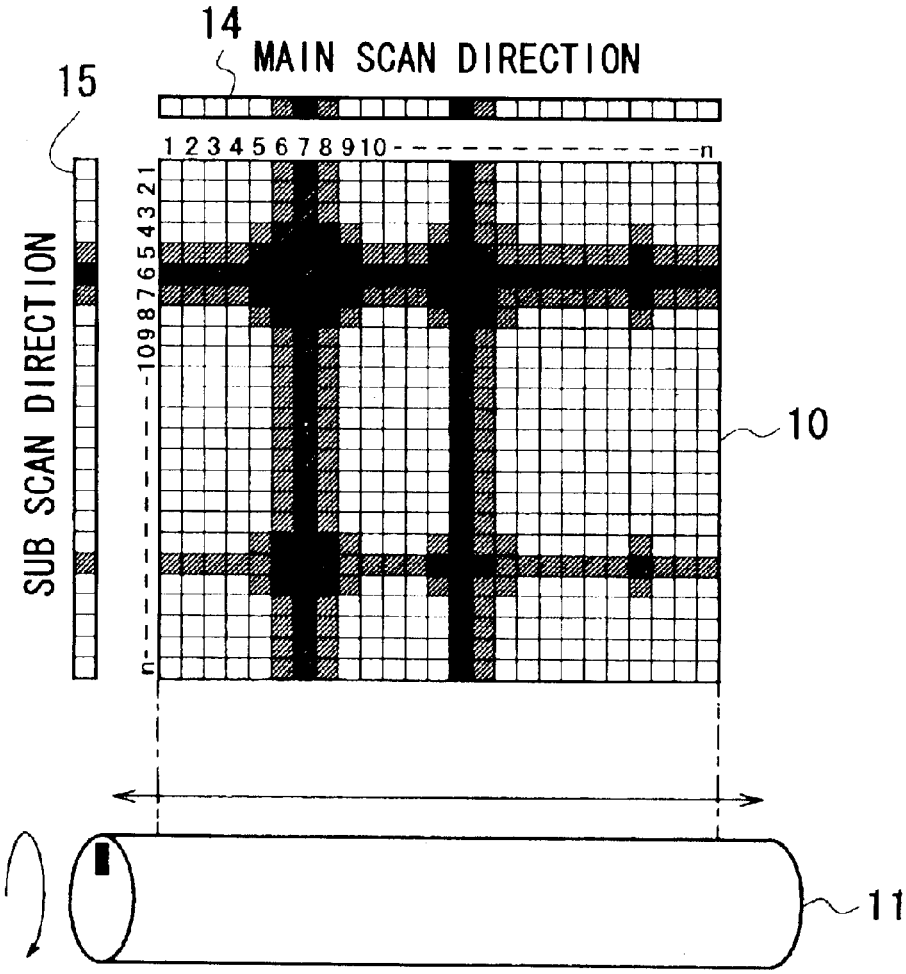
FIG. 14 is a schematic view for illustrating correction of a laser light quantity according to the sixth embodiment of the present invention.

This embodiment is shown in FIGS. 13 and 14.

In this embodiment, a circuit shown in FIG. 13 is used instead of the circuit shown in FIG. 5 as an internal construction of the pulse current control unit shown in FIG. 3.

More specifically, as shown in FIG. 14, the correction values are regularly distributed in the main and sub scanning directions, respectively, so that if the current correction values are also set for at least one line (e.g., 14 of FIG. 14 in the main scanning direction and 15 in the sub scanning direction), it becomes possible to perform the correction of the laser light quantity over the entire areas at the photosensitive member peripheral surface.

In this embodiment, the count value S52 indicating a position in the main scanning direction of the photosensitive drum and the count value S62 indicating a position in the subscanning direction are inputted into the memory 74 wherein correction values in the main and subscanning directions have been stored by using these count values S52 and S62 as addresses (e.g., 14 and 15 of FIG. 14). 8-bit correction values S14 and S15 in the main and subscanning directions corresponding to the address 5 values S52 and S62, respectively, are read out from the memory 74 and send to an arithmetic (operation) apparatus 75. In the arithmetic apparatus 75, a multiplexing operation in terms of at least one of an addition, subtraction, multiplication, and division operations of the correction values S14 and S15 are carried out to provide 16-bit correction values, from which only upper 8-bit correction values are outputted and send to the D/A converter 54. In the D/A converter 54, the 8-bit correction values are converted into analog values to be outputted to the pulse current source 42.

Similarly as in Embodiment 5, it becomes possible to control the laser light quantity so that the potential irregularity is two-dimensionally corrected in accordance with the tendency thereof in the main and sub scanning directions at the photosensitive member peripheral surface.

Further, an amount of memory usage is merely one for one line in each of the main and subscanning directions, thus resulting in a smaller amount of memory utilization.

Other Embodiments

As described hereinabove, the image forming apparatus of the present invention a a printer is described in detail. It should be noted, however, that the present invention is not limited to the above-mentioned embodiments. Specifically, the image forming apparatus of the present invention is applicable to all the image forming apparatus effecting image formation by irradiating a peripheral surface of photosensitive member with a laser beam, and also applicable to a system comprising plural equipments or an apparatus consisting of one equipment. Further, the aforementioned embodiments are explained by taking the apparatus performing transfer from the photosensitive member to recording paper (medium) as an example, but may also be applied to an apparatus performing transfer onto the recording paper via an intermediary transfer member used as an intermediate recording means.

Incidentally, the present invention may include the case Where the above-mentioned control of laser light quantity is accomplished by the use of a software program for realizing the functions and operations performed in the above embodiments. More specifically, such a software program are supplied to a system or apparatus directly or from a remote station, and a computer of the system or apparatus reads out supplied program codes, thus executing the laser light quantity control. In that case, the medium for that purpose does not need to be a software program so long as the medium has the above-mentioned programming function.

Accordingly, the processing of function of the image forming apparatus according to the present invention is realized by the computer. In other words, the program codes installed in the computer per se realizes the function processing in the present invention. Therefore, the accompanying claims embrace a computer program per se for realizing the function processing in the present invention. In this case, the for of the program may include programs executed by object code and interpreter, and script data supplied to an OS (operating system), if it has a programming function.

Examples of recording media for supplying the above program may include floppy disk; hard disk; optical disk, such as CD-ROM, CD-R, CD-RW, and DVD (DVD-ROM, DVD-R, etc.); magneto optical disk, such as MO; magnetic tape; and nonvolatile memory card.

It is also possible to supply the above program by downloading, into recording media such as a hard disk, the above-mentioned computer program as such or a compression file including automatic installation function from a web site on internet which is accessible by using a web browser of a client computer. Further, program codes constituting the above-mentioned program is divided into plural files and placed in different web sites, from which the respective files are separately downloaded. In other words, a WWW server allowing a plurality of users to download the program file for realizing the function processing in the present invention on the computer is also embraced in the accompanying claims.

The program may be encrypted and stored in recording media such as CD-ROMs and then is distributed to users, and then users satisfying a prescribed condition are allowed to download a key data for decryption from a web site via the internet, followed by execution of the encrypted program with the use of the key data to allow the users to install the program in their computers.

Further, the above-described functions and operations in the above embodiments may be realized by executing the program read out by the computer or by executing all or a part of actual processing through an OS running on the computer by instruction of the program.

It is also realize the functions and operations of the above embodiments of the present invention in such a manner that the program read out from the recording media is written in a memory provided to a function-extended board incorporated in a computer or a function-extended unit connected to a computer, and then based on an instruction of the program, e.g., a CPC provided to the function-extended board or unit executes all or a part of actual processing.

What is claimed is:

1. A method of controlling a laser beam for an image forming apparatus of a type wherein an electrostatic latent image is formed by irradiating a charged surface of a photosensitive member with a laser beam depending on a picture signal and is visualized with a recording agent, followed by transfer onto a recording medium to form an image, said method comprising:

a step of controlling predetermined drive currents supplied from a plurality of current sources including a first current source and a second current source so that a drive current supplied from the first current source is controlled to be constant during one scanning and a drive current supplied from the second current source is switched during one scanning at a plurality of points on the surface of the photosensitive member, based on light quantities of a laser beam at the time of supplying predetermined drive currents from the first and second current sources to predetermined areas, respectively, in a scanning direction of the laser beam at the surface of the photosensitive member.

2. A method according to claim 1, wherein the first current source is controlled by first control means and the second current source is controlled by second control means.

3. A method according to claim 1, wherein the first current source is a bias current source and the second current source is a pulse current source.

4. An image forming apparatus, comprising:

an image forming unit for irradiating a charged surface of a photosensitive member with a laser beam depending on a picture signal to form an electrostatic latent image, visualizing the latent image with a recording agent, and transferring the visualized image onto a recording medium to form an image, an APC circuit for adjusting a light quantity of the laser beam;

a first memory for storing a correction value in a main scanning direction of the photosensitive member for at least one line, a circumferential position detection unit for detecting a circumferential position irradiated with the laser beam at the surface of the photosensitive member, a second memory for storing a target light quantity of the APC circuit depending on the circumferential position, and a control unit for setting the target light quantity depending on the detected circumferential position and controlling a light quantity of the laser beam depending on the correction value stored in the first memory and the target light quantity.

5. An apparatus according to claim 4, further comprising a holding unit for holding the target light quantity the laser beam, and a readout unit for reading out at the target light quantity from the holding unit based on the detected circumferential position.

6. An apparatus according to claim 5, wherein the target light quantity is a light quantity for compensating a potential irregularity measured when the entire surface of the charged photosensitive member is irradiated with a predetermined light quantity of a laser beam.

7. An apparatus according to claim 5, wherein the holding unit is a memory for storing data indicating the target light quantity.

8. An apparatus according to claim 5, wherein the holding unit is means capable of outputting a plurality of current values indicating the target light quantity by switching.

9. An apparatus according to claim 4, wherein the control unit comprises a first control unit for turning a pulse current for driving the laser beam on and off depending on a picture signal, and a second control unit for controlling a bias current for driving the laser beam, and the laser beam is driven by a sum of the bias current and the pulse current.

10. An apparatus according to claim 9, further comprising a light quantity detection unit for detecting a light quantity of the laser beam, wherein the second control unit controls the bias current so that the target light quantity and a light quantity detected by the light quantity detection unit are compared and a difference therebetween is minimized.

11. An apparatus according to claim 10, wherein the light quantity detection unit detects a light quantity of the laser beam in a full drive state by the bias current and the pulse current, and the target light quantity is a target value of the laser light quantity in the full drive state.

12. An apparatus according to claim 9, wherein the first control unit variably controls a value of the pulse current for one pixel or plural pixels in a main scanning direction of the photosensitive member.

13. An apparatus according to claim 12, wherein the first control unit comprises the memory and the memory holds a value of the pulse current depending on a position in the main scanning direction of the photosensitive member.

14. An image forming apparatus, comprising:

an image forming unit for irradiating a charged surface of a photosensitive member with a laser beam depending on a picture signal to form an electrostatic latent image, visualizing the latent image with a recording agent, and transferring the visualized image onto a recording medium to form an image, a detection unit for detecting a position in a main scanning direction and a position in a sub scanning direction, at the surface of the photosensitive member irradiated with the laser beam, a memory having combinations of the positions in the main and sub-scanning directions at the surface of the photosensitive member as addresses and storing data indicating a target light quantity for each address, and a control unit for reading out the target light quantity from the memory depending on a position detected by the detection unit and controlling the laser beam so as to provide the target light quantity.

15. An apparatus according to claim 14, wherein the control unit comprises a first control unit for turning on and off a pulse current for driving the laser beam depending on a picture signal, and a second control unit for controlling a bias current for driving the laser beam, and the first control unit variably controls a value of the pulse current depending on the data read out from the memory.

16. An image forming apparatus, comprising:

an image forming unit for irradiating a charged surface of a photosensitive member with a laser beam depending on a picture signal to form an electrostatic latent image, visualizing the latent image with a recording agent, and transferring the visualized image onto a recording medium to form an image, a first memory for memorizing a correction value in a main scanning direction of the photosensitive member, a second memory for memorizing a correction value in a sub-scanning direction of the photosensitive member, an arithmetic unit for providing a correction value at a corresponding surface position of the photosensitive member by performing an arithmetic operation of the correction values in the main and sub-scanning directions, a circumferential position detection unit for detecting a circumferential position of the photosensitive member irradiated with the laser beam, and a control unit for controlling the laser beam depending on the correction value provided by the arithmetical unit and the circumferential position detected by the circumferential position detection unit.

17. An apparatus according to claim 16, wherein the arithmetic unit provides a correction value by performing an arithmetic operation in terms of at least one of addition, subtraction, multiplication and division operations.

18. An apparatus according to claim 16, wherein the correction values memorized in the first and second memories are those with respect to a light quantity of the laser beam, and the light quantity of the laser beam is controlled in accordance with the correction value provided by the arithmetic unit.

* * * * *

UNITED STATES PATENT AND TRADEMARK OFFICE

CERTIFICATE OF CORRECTION

PATENT NO. : 6,795,099 B2
DATED : September 21, 2004
INVENTOR(S) : Katsuhide Koga et al.

It is certified that error appears in the above-identified patent and that said Letters Patent is hereby corrected as shown below:

Column 1,
Line 22, “qualities.” should read -- quality. --.

Column 3,
Line 10, “qualities.” should read -- quality. --; and
Line 65, “arithmetical” should read -- arithmetic --.

Column 4,
Line 45, “con:struction” should read -- construction --; and
Line 61, “potential 26” should read -- potential --.

Column 5,
Lines 37 and 41, “sub” should read -- sub- --;
Line 46, “distribution” should read -- distributions --;
Line 47, “is” should read -- are --; and
Line 54, “a” should be deleted.

Column 6,
Line 41, “correct” should read -- corrects --.

Column 7,
Line 4, “rom” should read -- from --; and
Line 51, “in” (second occurrence) should read -- is --.

Column 8,
Line 12, “lead” should read -- leads --;
Line 18, “unit,” should read -- units, --;
Lines 24 and 25, “sub” should read -- sub- --; and
Line 48, “inputted” should read -- inputted into --.

Column 9,
Line 14, “reaches” should read -- reach --;
Line 28, “scanning” should read -- scannings --; and
Line 57, “depending-on” should read -- depending on --.

Column 10,
Line 32, “readout” should read -- read-out --; and
Line 34, “values” should read -- value --.

UNITED STATES PATENT AND TRADEMARK OFFICE

CERTIFICATE OF CORRECTION

PATENT NO. : 6,795,099 B2
DATED : September 21, 2004
INVENTOR(S) : Katsuhide Koga et al.

It is certified that error appears in the above-identified patent and that said Letters Patent is hereby corrected as shown below:

Column 11,
Line 4, “send” should read -- sent --;
Line 18, “a” (first occurrence) should read -- of --;
Line 34, “Where” should read -- where --;
Line 38, “are” should read -- is --;
Line 52, “the for of” should be deleted; and
Line 66, “is” should read -- are --.

Column 12,
Line 17, “realize” should read -- possible to realize --; and
Line 60, “beam;” should read -- beam, --.

Column 13,
Line 10, “quantity” should read -- quantity of --; and
Line 11, “at” should be deleted.

Column 14,
Line 2, “sub scanning” should read -- sub-scanning --; and
Line 32, “arithmetical” should read -- arithmetic --.

Signed and Sealed this

Twenty-second Day of February, 2005

JON W. DUDAS
*Director of the United States Patent and Trademark Office*